US005541024A

United States Patent [19]

Nair et al.

[11] Patent Number: 5,541,024

[45] Date of Patent: Jul. 30, 1996

[54] TONER PARTICLES PRODUCED BY LIMITED COALESCENCE POLYMERIZATION

[76] Inventors: Mridula Nair; Zona R. Pierce; Louis J. Rossi, all of Eastman Kodak Company, Rochester, N.Y. 14650

[21] Appl. No.: 476,210

[22] Filed: Feb. 7, 1990

[51] Int. Cl.[6] ..... G03G 5/00; G03G 9/00

[52] U.S. Cl. ..... 430/137; 430/106; 430/109; 430/111

[58] Field of Search ..... 430/106, 109, 430/137, 111

[56] References Cited

U.S. PATENT DOCUMENTS

| | | | |
|---|---|---|---|
| 3,781,208 | 12/1973 | Ueda et al. | 252/62.1 |
| 4,322,487 | 3/1982 | Merrill et al. | 430/37 |
| 4,414,152 | 11/1983 | Santilli et al. | 260/185 |
| 4,414,320 | 11/1983 | Santilli et al. | 430/106 |
| 4,965,131 | 10/1990 | Nair et al. | 430/137 |

FOREIGN PATENT DOCUMENTS

| | | |
|---|---|---|
| 0334126 | 9/1989 | European Pat. Off. . |

*Primary Examiner*—George F. Lesmes
*Assistant Examiner*—Bernard P. Codd

[57] ABSTRACT

Neutral density pigmented toner particles are produced by limited coalescence polymerization. The organic neutral density black colorant employed is a 1,4-bis arylazo derivative of 2,3-naphthalenediol.

13 Claims, No Drawings

TONER PARTICLES PRODUCED BY LIMITED COALESCENCE POLYMERIZATION

FIELD OF THE INVENTION

This invention is in the field of toner particles produced by limited coalescence using a 1,4-bis aryl-azo substituted 2,3-naphthalenediol colorant.

1. Background of the Invention

Polymer particles having a narrow size distribution can be produced in an aqueous medium containing a dispersed colloidal-sized stabilizer that controls particle size and size distribution. For example a limited coalescence polymerization process is shown in U.S. Pat. No. 3,615,972 where a stabilizer, such as colloidal silica, is used, and suspended small droplets of a non-aqueous, water immiscible liquid monomer composition are polymerized. The polymer particles are separated, washed, and dried.

Another example is an evaporation limited coalescence process, where the stabilizer used is also a colloidal silica, or the like, and where the suspended small droplets comprise a solution of polymer in a non-aqueous, water immiscible solvent liquid. The solvent is removed and the particles are separated, washed and dried. Such a process is disclosed in U.S. Pat. No. 4,833,060.

A further example is a limited coalescence process wherein the stabilizer used is an emulsion polymerized aqueous latex of certain copolymers containing oleophilic and hydrophilic combined monomers as in disclosed in published European Patent Application No. 0 334 126.

2. Summary of the Invention

This invention relates to toner particles containing a dispersed, neutral density black azo substituted 2,3-naphthalenediol colorant and to limited coalescence processes for making these toner particles.

The present invention permits the use of a black organic colorant that overcomes the disadvantages of using carbon in limited coalescence processes. The toner particles of the present invention have improved triboelectric and transfer properties.

The present invention provides neutral density colored toner particles of small and highly uniform size for multicolor imaging processes.

DETAILED DESCRIPTION (a) Definitions

The term "particle size" as used herein, or the term "size" or "sized" as employed herein in reference to the term "particles", means volume weighted diameter as measured by conventional diameter measuring devices, such as a Coulter Multisizer, sold by Coulter Electronics, Inc. Mean volume weighted diameter is the sum of the mass of each particle times the diameter of a spherical particle of equal mass and density, divided by total particle mass.

The term "glass transition temperature" or "$T_g$" as used herein means the temperature at which a polymer changes from a glassy state to a rubbery state. This temperature ($T_g$) can be measured by differential thermal analysis as disclosed in "Techniques and Methods of Polymer Evaluation", Vol. 1, Marcel Dekker, Inc., N.Y. 1966.

(b) The Neutral Density Colorants

The neutral density colorants employed in the practice of this invention are 1,4-bis arylazo derivatives of 2,3-naphthalenediol that are characterized by the formula:

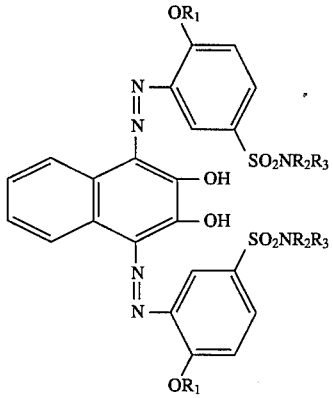

(1)

wherein:

$R_1$ is $C_1$ to $C_4$ alkyl;

$R_2$ is selected from the group consisting of hydrogen and methyl; and $R_3$ is $C_1$ to $C_8$ alkyl.

When the alkyl group contains more than two carbon atoms, the alkyl group may be branched.

The compounds of Formula (1) can be prepared by methods provided in the art; see, for example, U.S. Pat. Nos. 4,145,299; 4,414,152 and 4,654,282. For instance, 3-acetamido-4-methoxy-N-n-butylbenzenesulfonamide can be prepared in accordance with the equation:

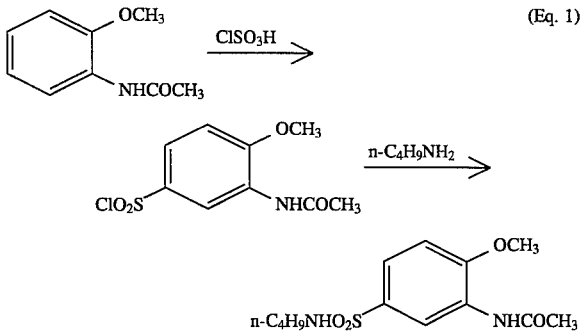

(Eq. 1)

The sulfonamide is then used to prepare 1,4-bis(2-methoxy-5-N-n-butylsulfamoylphenylazo)-2,3naphthalenediol in accordance with the equation:

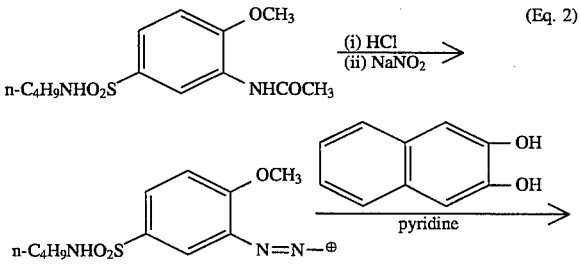

(Eq. 2)

-continued

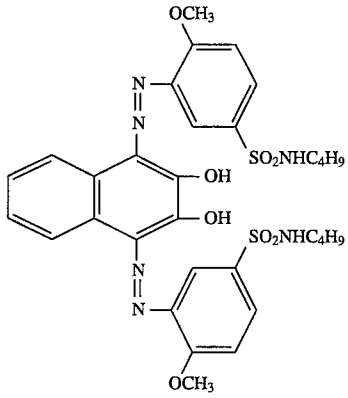

Formula (1) compounds are useful as lipophilic neutral density organic colorants in limited coalescence technology. The compounds of Formula (1) also appear to display superior light stability (or colorfastness) due to the introduction of alkyl substituted sulfonamide moieties and further provide the necessary lipophilic character thereby facilitating their use as colorants in limited coalescence technology. Mixtures of different Formula (1) compounds can also be used.

The particles of Formula (1) compounds must be smaller in particle size than the particle size of the dispersed droplets contemplated for use in the aqueous medium employed for toner particle preparation in accordance with the present invention.

In order to prepare a pigment having a size as above indicated, it may be desirable to reduce the particle size of a pigment from an initial size to a submicron or colloidal size. Thus, the pigment in combination with a polymeric pigment dispersant of the type employed in the practice of this invention can be ball milled in the presence of the polymerizable monomer mixture, or the thermoplastic polymer solution or, even compounded with the thermoplastic polymer on a hot roll mill.

(c) Additives

Toner particles of this invention can contain in addition to Formula (1) compound other additives which are dissolved or dispersed in the thermoplastic polymer. In particular, toner particles of this invention usually and preferably contain a charge control agent.

Suitable charge control agents can be selected from among those taught in the prior art; see, for example, the teachings of U.S. Pat. Nos. 3,893,935; 4,079,014; and 4,323,634; and British Patent Nos. 1,501,065 and 1,420,839.

Examples of other types of additives include plasticizers, pigment dispersants and promoters, as for example, those disclosed in U.S. Pat. No. 4,833,060.

(d) The Aqueous Medium

In the practice of the process of this invention, an aqueous medium is employed. This medium, as is typical of a so-called limited coalescence process, contains dispersed therein colloidally sized suspending agents which function to control particle size and size distribution in the toner powders.

Suitable colloidal suspending agents include, for example, calcium phosphate, silica, alumina, methyl cellulose, and the like. One presently preferred type of suspending agent comprises colloidal silica used in conjunction with a promoter. Another presently preferred type of suspending agent comprises an aqueous latex of a colloidal copolymer which comprises:

(a) about 25 to about 80 weight percent of an addition polymerizable nonionic oleophilic monomer;

(b) about 5 to about 45 weight percent of an addition polymerizable hydrophilic monomer;

(c) about 1 to about 50 weight percent of an addition polymerizable ionic monomer; and (d) about 8 to about 20 weight percent of cross-linking monomer having at least two addition polymerizable groups.

Preferably, the copolymer comprises about 35 to about 65 weight percent nonionic oleophilic monomer, about 10 to about 35 weight percent nonionic hydrophilic monomer, about 10 to about 20 weight percent ionic monomer, and about 2 to about 15 weight percent cross-linking monomer.

The quantity of colloidal suspending agent, promoter, pH control agent and other additives present in the aqueous medium typically is in the range of about 0.2 to about 20 weight percent on a 100 weight percent total aqueous medium basis, and preferably in the range of about 0.5 to about 6 weight percent.

While the non-aqueous liquid organic phase is dispersed as droplets in the aqueous phase, the colloidal suspending agents serve as a third phase. These agents are insoluble in both the aqueous phase and the non-aqueous phase; however, these agents are in effect wetted by the droplets and the aqueous phase. The colloidal suspending agents are more hydrophilic than oleophilic, and more hydrophilic than the dispersed or suspended droplets. Thus, they remain at the interface of the aqueous phase and the suspended droplets. The colloidal suspending agents substantially uniformly cover the surface of the suspended droplets and can be regarded as forming a layer on such droplets.

(e) polymerization Limited Coalescence

In accordance with the present invention, a limited coalescence suspension polymerization process is used to produce toner particles containing a dispersed neutral density colorant of Formula (1).

Thus, a neutral density colorant of Formula (1) is colloidally dispersed in a polymerizable water immiscible liquid monomer composition by known techniques together with additives as described herein.

The liquid monomer composition is preferably comprised of monomers that are water immiscible or insoluble, so that they do not dissolve or merge with the aqueous medium. While a wide variety of monomers can be used for this purpose, typical and illustrative suspension polymerizable toner monomers include those that contain ethylenic unsaturation and polymerize by addition. Suitable monomers include for example, styrene, p-chlorostyrene; vinyl naphthalene; ethylenically unsaturated mono-olefins, such as ethylene, propylene, butylene and isobutylene; vinyl halides, such as vinyl chloride, vinyl bromide, vinyl fluoride; vinyl carboxylates, such as acetate; vinyl propionate, vinyl benzoate, vinyl butyrate, and the like; esters of alpha-methylene aliphatic monocarboxylic acids, such as methyl acrylate, methyl methacrylate, ethyl acrylate, n-butylacrylate, isobutyl acrylate, dodecyl acrylate, n-octyl acrylate, 2-chloroethyl acrylate, phenyl acrylate, methyl-alphachloroacrylate, methyl methacrylate, ethyl methacrylate and butyl methacrylate, and the like; acrylic compounds, such as acrylic acid, methacrylic acid,; acrylonitrile; methacrylonitrile; acrylamide; vinyl ethers, such as vinyl methyl ether, vinyl isobutyl ether, vinyl ethyl ether, and the like; vinyl ketones, such as vinyl methylketone, vinyl hexyl ketone, methyl isopropyl ketone, and the like; vinylidene halides, such as vinylidene chloride, vinylidene chlorofluoride, and the like; N-vinyl compounds, such as N-vinyl pyrrole, N-vinyl carbazole, N-vinyl indole, N-vinyl pyrrolidene, and the like; divinyl benzene; styrene and various derivatives of styrene, such as methylstyrene, ethylstyrene, and the like; allyl compounds, such as allyl chloride, methallyl ethyl ether, and the like and mixtures thereof. A presently preferred monomer composition is a mixture containing styrene or a derivative of styrene and an acrylate; butylacrylate is especially preferred in such a mixture as it produces a thermoplastic polymer having a $T_g$ in the range of 40° to 100° C.

The resulting non-aqueous liquid dispersion is then admixed under high shear conditions with the aqueous medium described above to produce a suspension of micron-sized droplets of the dispersion in the aqueous medium. Typically, these droplets are highly uniform in size and the size is in the range of about 2 to about 30 microns, and preferably about 5 to about 10 microns. During the high shear mixing, an equilibrium is reached as regards droplet size. Droplet size deviation is typically about ±25% of the mean.

Next, the monomer mixture in the suspended droplets is polymerized. The polymerization can be accomplished by heating or irradiating the droplet suspension under mild to moderate agitation. An initiator that is included in the dispersion before it is admixed with the aqueous medium promotes the polymerization. Examples of suitable initiators for such a suspension polymerization include organic soluble free radicals e.g., Vazo 52 (DuPont) 2,2'-azobis(2,4-dimethylnitrate) and benzoyl peroxide.

Typical suspension heating temperatures are in the range of about 30° to about 100° C. However, the particular conditions used for polymerization in any given situation depend upon a number of variables, such as the monomer composition, the initiators present, and the like. The use of gentle continuous agitation aids in preventing droplet agglomeration or coalescing.

After polymerization is complete, as shown by the consumption of monomers and the development of suspended particles with Formula (1) compound(s) dispersed therein, the particles can be separated from the aqueous medium by any conventional means, including settling, filtration, centrifuging, combinations thereof, or the like. After separation, the particles are preferably washed with water and residual suspending agents removed.

In the case, for example, of silica, it can be removed by washing with a dilute aqueous alkali metal or ammonium hydroxide. If washed with base, the particles are thereafter further water washed until a neutral pH (about 7) is reached. The resulting particles are then conveniently drained and dried to remove residual water.

A suitable drying temperature is in the range of about ambient to about 60° C. applied for times of about 3 to about 24 hours.

The particles produced by such a suspension polymerization and drying process have a particle size that is preferably in the range of about 5 to about 10 microns.

(f) Evaporation Limited Coalescence

In accordance with the present invention, a limited coalescence polymer suspension process is used to produce toner particles containing a dispersed neutral density colorant.

Thus, a neutral density colorant of Formula (1) is colloidally dispersed in a solution or a colloidal dispersion of thermoplastic polymer in a water-immiscible organic carrier liquid by known techniques. The dispersion contains additives as described herein.

Examples of suitable polymers which can be used if they are found to have characteristics as above indicated include, for example, olefin homopolymers and copolymers, such as polyethylene, polypropylene, polyisobutylene, polyisopentylene, and the like; polyfluoroolefins, such as polytetrafluoroethylene; polyamides, such as polyhexamethylene adipamide, polyhexamethylene sebacamide and polycaprolactam, and the like; acrylic resins, such as polymethylmethacrylate, polyacrylonitrile, polymethylacrylate, polyethylmethacrylate styrene-methylmethacrylatae copolymers, ethylene-methyl acrylate copolymers, ethylene-ethyl acrylate copolymers, ethylene-ethyl methacrylate copolymers,and the like; polystyrene and copolymers of styrene with unsaturated monomers, cellulose derivatives, such as cellulose acetate, cellulose acetate butyrate, cellulose propionate, cellulose acetate propionate, ethyl cellulose and the like; polyesters; polycarbonates; polyvinyl resins, such as polyvinyl chloride, copolymers of vinyl chloride, vinyl acetate, polyvinyl butyral, polyvinyl alcohol, polyvinyl acetal, ethylene-vinyl acetate copolymers, ethylene-vinyl alcohol copolymers, and the like; allyl polymers, such as ethylene-allyl copolymers, ethylene-allyl alcohol copolymers, ethylene-allyl acetone copolymers, ethylene-allyl benzene copolymers, ethylene-allyl ether copolymers, and the like; ethylene-acrylic copolymers; polyoxymethylene; and various polycondensation polymers, such as polyurethanes, polyamides, and the like; and mixtures thereof.

Presently preferred are condensation polyesters.

Various water immiscible organic carrier liquids can be used. Examples of useful carrier liquids that preferably dissolve the polymer and which are also immiscible with water include, for example, chloromethane, dichloromethane, ethyl acetate, vinyl chloride, methyl ethyl ketone, trichloromethane, carbon tetrachloride, ethylene chloride, trichlorethane, toluene, xylene, cyclohexanone, 2-nitropropane, mixtures thereof, and the like. A particularly useful carrier liquid is ethyl acetate or dichloromethane because they are good solvents for many polymers while at the same time they are immiscible with water. Further, their volatility is such that they can be readily removed from the discontinuous phase droplets by evaporation during particle preparation.

The dispersion is then admixed under high shear conditions with the aqueous medium described above to produce a suspension of micron-sized droplets of the dispersion in the aqueous medium. Typically, these droplets are highly uniform in size and the size is in the range of about 2 to about 50 microns, and preferably about 7 to about 12 microns. During the high shear mixing, an equilibrium is reached as regards droplet size. Droplet size deviation is typically about ±25% of mean.

Next, while gentle agitation is employed, evaporation of the water immiscible organic carrier liquid from the discontinuous phase is carried out. Initially, the average particle size of the suspended material reflects a swollen condition because of the presence of the carrier liquid. As evaporation occurs, the size of the particles decreases. Any convenient condition can be employed for accomplishing evaporation, such as subjecting the suspension to subatmospheric pressures while stirring. Suitable subatmospheric pressures are in the range of about 10 to about 25 mm Hg.

As a result of the carrier liquid evaporation, the particle size of the resulting solid particles is in the range of about 1.5 to about 30 microns, and preferably about 2 to about 20 microns.

After evaporation of the carrier liquid has been accomplished, the suspended particles are separated, washed to a preferably neutral pH, and dried using a procedure such as above described in reference to the foregoing particle preparation method of this invention. Dried particles have characteristics similar to those of the particles that are produced by suspension polymerization using limited coalescence.

Specifically, the particles produced by such a polymer suspension polymerization process have a particle size preferably within the range of about 2 to about 20 microns. Preferably, on a 100 weight percent total dispersion basis, the quantity of Formula (1) colorant present therein is in the range of about 5 to about 20 weight percent.

(g) Pigmented Toner Powders

Toner powders (or particles) of the present invention thus comprise:

at least one compound of Formula (1); and a thermoplastic polymer having a glass transition temperature in the range of about 40° to about 100° C., preferably about 50° to about 65° C.

Toner powders preferably contain a charge control agent.

The pigmented toner particles have a particle size in the range of about 3 to about 30 microns, and preferably in the range of about 5 to about 10 microns.

Preferably, a group of particles of this invention has a narrow particle size distribution. For example, a size deviation in the range of about ±25% from a mean particle size is presently preferred, although somewhat larger and smaller such deviations can be employed, if desired.

Preferred toner particles of this invention on a 100 weight percent total weight basis comprise:

about 5 to about 20 weight percent of Formula (1) compound;

about 0.005 to about 5 weight percent charge control agent; and about 75 to about 94.995 weight percent polymer.

The invention is illustrated by the following examples:

EXAMPLE 1

Preparation of 3-Acetamido-4-methoxy-N-n-butylbenzenesulfonamide

As shown in Eq. 1 (above), o-acetanisidide (100 gms., 0.605 mole) was added in portions to 200 ml of chlorosulfonic acid at about 50° C. (cooling was necessary). After the addition, the amber solution was heated at about 50° to 60° C. for four hours, cooled to room temperature and carefully added to an ice water mixture (1.5 kg). A white precipitate was collected, washed free of acid, and pressed dry. A portion of sulfonyl chloride (0.100 mole) was dissolved in 100 ml of tetrahydrofuran and treated with 16.1 gms (0.221 mole) of n-butylamine (exotherm to 50° C.). The reaction mixture was refluxed an additional 15 minutes, the condenser removed, and the solvent removed by heating. The white crystalline solid that remained was slurried with 100 ml of water, collected and dried to give 27.7 gms (92.4 percent) of the sulfonamide (melting point 115°–117° C).

Anal. calc'd for $C_{13}H_{20}N_2O_4S$:C, 52.0; H, 6.74; N, 9.35;S, 10.7

EXAMPLE 2:

Preparation of 1,4-bis(2-methoxy-5-N-n-butylsulfamoylphenylazo)-2,3- naphthalenediol As shown in Eq. 2 (above), 3-acetamido-4-methoxy-N-n-butylsulfonamide as prepared in Example 1 was suspended in 112 ml of 3N hydrochloric acid and heated for 10 minutes after solution resulted. The amber solution was cooled to 0° C. and the resulting slurry was diazotized with treatment of 6.6 gms (0.096 mole) of sodium nitrile in 15 ml of water. After addition, the solution was stirred for 15 minutes at 0° C., and then filtered to remove any insoluble debris. The diazonium salt solution was then added dropwise at 0°–10° C. to a stirred solution of 7.1 gms (0.044 mole) of 2,3-naphthalenediol in 250 ml of pryidine solvent. The mixture was stirred for one hour at about 5° to 10° C. after addition was complete and the stirring was maintained overnight without further cooling. A dark solid was collected, washed with 20 ml of pyridine, then with 100 ml of methanol and finally warm water (at 70° C.) to produce 25 gms of crude product whose melting point was about 290° C. after drying. This product was recrystallized from dimethylformamide to give 20.2 gins (66 percent) of a product whose melting point was 295°–297° C.

Anal. calc'd for $C_{32}H_{38}N_6O_8S_2$: C, 55.0; H, 5.5; N,12.0; S,9.2

Found: C,55.1; H,5.6; N,11.8; S,8.8.

The product was found to be a black pigment having a particles size of about 2 microns. Spectroscopic analysis showed this pigment to have a substantially neutral optical density (black).

EXAMPLES 3–10

Preparation of Additional Compounds

The procedure of Examples 1 and 2 is repeated with various alternative starting materials being substituted for those indicated to produce additional compounds of Formula (1) as shown in the following Table I:

TABLE I

| Ex. | Compounds of Formula I | | |
|---|---|---|---|
| No. | $R_1$ | $R_2$ | $R_3$ |
| 3 | $CH_3$ | H | n-$C_3H_7$ |
| 4 | $CH_3$ | $CH_3$ | $CH_3$ |
| 5 | $C_2H_5$ | H | n-$C_4H_9$ |
| 6 | $CH_3$ | H | —$CH(CH_3)C_2H_5$ |
| 7 | $CH_3$ | H | i-$C_3H_7$ |
| 8 | $CH_3$ | H | t-$C_5H_{11}$ |
| 9 | $CH_3$ | H | —$CH_2CH(CH_3)_2$ |
| 10 | $CH_3$ | H | —$CH_2CH_2CH(CH_3)_2$ |

EXAMPLE 11

Preparation of Styrene Butylacrylate Toner Particles Containing Dispersed Neutral Density Pigment by Polymerization Limited Coalescence A mill grind was prepared in a 250 ml bottle filled to one-half its volume with stainless steel shot about 3 mm in diameter. The following composition was added to the bottle:

| Item No. | Component | Quantity (gms) |
|---|---|---|
| 1. | Monomers | 84 |
| 2. | Block Copolymer | 4 |
| 3. | Carboxylate copolymer | 4 |
| 4. | Pigment produced in Example 2 | 8 |
| 5. | Charge Agent | 2 |

Item No. 1 is a monomer mixture of 75 weight percent styrene, 24.8 weight percent butyl acrylate, and 0.2 weight percent ethylene glycol dimethacrylate (100 weight percent copolymer basis).

Item No. 2 is a styrene-alkylene block copolymer pigment dispersant obtained commercially from Shell Chemical Co. under the trade designation "Kraton™ G 1652".

Item No. 3 is a pigment dispersant comprising a preformed copolymer of 98 weight percent 4-t-butyl styrene and 2 weight percent methacrylate wherein all of the methacrylate carboxyl groups were converted to the lithium salt.

The bottle is capped and placed on a roll mill for 44 hours at ambient temperature. The pigment in the dispersion has a particle size of less than 0.1 micron. The dispersion is decanted from the bottle and 2.24 g "Vazo™ 52" and 0.18 g dodecanethiol are added to the dispersion with stirring which is continued for one hour.

An aqueous medium is prepared in a one-liter beaker equipped with a magnetic stirring bar and comprises 300 ml deionized water; 10 ml "Ludox™", an aqueous colloidal silica; 3 ml poly(adipic acid-comethylamino ethanol) (10 percent); and 3 ml potassium dichromate (2.5 percent). The pH is adjusted to 4 with 1N HCl.

The mill grind is then added to the aqueous medium with rapid stirring. The resulting coarse dispersion is passed twice through a Microfluidics Model "110T™" microfluidizer. The homogenized suspension is pumped into a 3 neck round bottom flask (250 ml capacity) equipped with a paddle stirrer, reflux condenser, and stopper. The flask is placed in a 50° C. constant temperature bath and gently stirred for 17 hours at 50° C., and then at 70° C. for 4 hours to polymerize the suspended monomer droplets. The resulting suspended toner particles are then separated from the aqueous medium by sieving through a 400 mesh screen, collecting on a fine frit filter funnel and washing with deionized water.

The toner particles are then slurried in an aqueous 1N KOH solution for 25 minutes. To this slurry is added 1 percent by weight of an aqueous surfactant ("Zonyl™ FSN" obtained from E. I. DuPont de Nemours & Co.) and the mixture stirred for 17 hours. The resulting toner particles are collected on a medium frit filter funnel and washed with 0.1 N KOH. The particles are washed with deionized water until a neutral pH is obtained. The resulting particles are tray dried overnight at about 25° C. The particles are then classified and evaluated.

EXAMPLE 12

Preparation of branched Polyester Particles Containing 1,4-bis aryl-azo Derivative of 2,3-Naphthalenediol using Polymer Suspension A 0.4 intrinsic viscosity (measured in dichloromethane) branched polyester is compounded to produce the following composition:

| Component | Quantity (grams) |
|---|---|
| Branched polyester | 18 |
| 1,4-bis aryl azo derivative of 2,3-naphthalenediol benzyldimethyloctadecyl ammonium chloride | 18 |
| Charge control agent | 0.3 |

Into a 900 ml jar equipped with a magnetic stir bar was placed 600g of ethyl acetate and 36g of the above identified composition. The resulting dispersion was stirred for 17 hours on a stir plate.

2250 ml of phthalate buffer at a pH of 4, 65 ml of Nalcoag™ 1060 (a colloidal silica available from Nalco Chemical Co.), and 19 ml of 10 percent aqueous poly(adipic acid-co-methylaminoethanol) were homogenized in a Silverson homogenizer.

The organic dispersion was added to the homogenized mixture with stirring. The resulting coarse suspension was placed in a Microfluidics Model 110™ microfluidizer operating at 40 psi and discharged into a 4 liter, 3 neck round bottom flask equipped with a paddle stirrer. Stirring was maintained in the flask at 100 rpm under a nitrogen sweep for 17 hours.

An aspirator was attached to the flask and the dispersion was stirred under a vacuum of 20 mm Hg for 3 hours. The vacuum was removed and the resulting dispersion was filtered through a coarse screen, collected on a medium frit filter funnel, and washed with deionized water until the filtrate was clear. The recovered particulate solids were slurried in 0.1N KOH for 17 hours, collected on a medium frit filter funnel, and washed with deionized water until a neutral pH in the wash water was achieved. The recovered particulate solids were tray dried for 48 hours at 20° C. and then sieved through a 140 USBF mesh screen.

The resulting toner particles contained the neutral density azo substituted 2,3-naphthalenediol colorant. The toner particles displayed excellent transfer capacity and triboelectric properties.

The invention has been described in detail with particular reference to preferred embodiments thereof, but it will be understood that variations and modifications can be effected within the spirit and scope of the invention.

We claim:

1. A process for making toner particles containing a dispersed neutral density colorant comprising the steps of:

(A) colloidally dispersing in a polymerizable, water immiscible liquid monomer composition, which includes an acrylate, styrene or a derivative of styrene, and additional components including an initiator, a pigment dispersant, charge control agent, and a neutral density colorant having the formula:

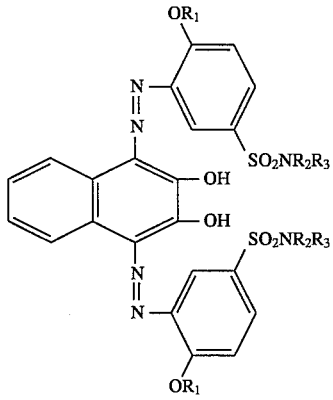

$R_1$ is $C_1$ to $C_4$ alkyl;

$R_2$ is selected from the group consisting of hydrogen and methyl; and $R_3$ is $C_1$ to $C_8$ alkyl;

(B) admixing under high shear conditions the dispersion produced in step (A) with an aqueous medium containing a promoter and having dispersed within the aqueous medium a colloidal stabilizer to break up said dispersion into droplets;

(C) stirring the suspension produced in step (B) while polymerizing said monomer composition to produce particles; and (D) separating and drying said particles.

2. The process of claim 1 wherein said colloidal stabilizer comprises silica.

3. The process of claim 1 wherein said colloidal stabilizer comprises an aqueous latex copolymer that comprises about 25 to about 80 weight percent of an addition polymerizable nonionic oleophilic monomer; about 5 to about 45 weight percent of an addition polymerizable nonionic hydrophilic monomer; about 1 to about 50 weight percent of an addition polymerizable ionic monomer; and about 2 to about 20 weight percent of a cross-linking monomer having at least two addition polymerizable groups per molecule.

4. The process of claim 1 wherein said particles have a size in the range of about 2 to about 20 microns.

5. The process of claim 1 wherein the product of step (C) on a 100 weight percent total solids basis comprises about 75 to about 95 weight percent of polymer, and about 5 to about 20 weight percent of said colorant, and said suspension comprises about 20 to about 30 weight percent of polymer and said additional components with the balance being carrier liquid.

6. The process of claim 5 wherein said dispersion contains about 0.005 to about 5 weight percent of the charge control agent.

7. A process for making toner particles containing a dispersed neutral density colorant comprising the steps of:

(A) colloidally dispersing and/or dissolving in a water immiscible organic carrier liquid a neutral density colorant having the formula:

wherein $R_1$ is $C_1$ to $C_4$ alkyl $R_2$ is selected from the group consisting of hydrogen and methyl; and $R_3$ is $C_1$ to $C_8$ alkyl; and a thermoplastic polymer;

(B) admixing under high shear conditions said dispersion with an aqueous medium containing a promoter and a charge control agent and having dispersed in said aqueous medium a colloidal stabilizer to break up said dispersion into droplets suspended in said aqueous medium, wherein the quantity of said stabilizer in said aqueous medium is sufficient to cause said droplets to have a size in the range of about 2 to about 30 microns to produce a suspension;

(C) stirring the suspension while evaporating therefrom said organic carrier liquid to produce particles; and (D) separating and drying said particles.

8. The process of claim 7 wherein the charge control agent is dissolved in said dispersion.

9. The process of claim 7 wherein said colloidal stabilizer comprises silica.

10. The process of claim 7 wherein said colloidal stabilizer comprises an aqueous latex copolymer that comprises about 25 to about 80 weight percent of an addition polymerizable nonionic oleophilic monomer; about 5 to about 45 weight percent of an addition polymerizable nonionic hydrophilic monomer; about 1 to about 50 weight percent of an addition polymerizable ionic monomer; and about 8 to about 20 weight percent of a cross-linking monomer having at least two addition polymerizable groups per molecule.

11. The process of claim 7 wherein said particles have a size in the range of about 2 to about 20 microns.

12. The process of claim 7 wherein on a 100 weight percent total solids basis said dispersion comprises:

about 75 to about 95 weight percent of said polymer; and about 5 to about 20 weight percent of said colorant.

13. The process of claim 12 wherein said dispersion additionally contains about 0.005 to about 5 weight percent of a charge control agent.

* * * * *